US005941047A

United States Patent [19]

Johansson

[11] Patent Number: 5,941,047

[45] Date of Patent: Aug. 24, 1999

[54] FLOOR-LAYING

[76] Inventor: Dan Johansson, Kråkvägen 69, S-517 34 Bollebygd, Sweden

[21] Appl. No.: 08/860,194

[22] PCT Filed: Dec. 13, 1995

[86] PCT No.: PCT/SE95/01504

§ 371 Date: Sep. 10, 1997

§ 102(e) Date: Sep. 10, 1997

[87] PCT Pub. No.: WO96/18782

PCT Pub. Date: Jun. 20, 1996

[30] Foreign Application Priority Data

Dec. 13, 1994 [SE] Sweden ..... 9404349

[51] Int. Cl.[6] ..... E04F 15/02

[52] U.S. Cl. ..... 52/747.1; 52/747.11; 52/749.11; 52/390; 52/403.1

[58] Field of Search ..... 52/747.1, 747.11, 52/748.1, 749.11, 749.14, 390, 403.1, 392, DIG. 1; 428/90, 91, 40.1; 156/71, 72, 304.5

[56] References Cited

U.S. PATENT DOCUMENTS

| | | | |
|---|---|---|---|
| 1,925,070 | 8/1933 | Livezey | 52/747.1 X |
| 2,173,622 | 9/1939 | Crooks et al. | 52/747.1 X |
| 3,014,829 | 12/1961 | Curtin | 156/304.5 X |
| 3,902,293 | 9/1975 | Witt et al. . | |
| 4,482,593 | 11/1984 | Sagel et al. | 428/90 |
| 4,543,765 | 10/1985 | Barrett | 52/747.1 |
| 4,694,627 | 9/1987 | Omholt | 52/390 |
| 4,699,677 | 10/1987 | Rooklyn | 156/71 |

FOREIGN PATENT DOCUMENTS

| | | |
|---|---|---|
| 9508033 | 3/1995 | European Pat. Off. . |
| 2427712 | 12/1975 | Germany . |

*Primary Examiner*—Carl D. Friedman
*Assistant Examiner*—Winnie S. Yip
*Attorney, Agent, or Firm*—Fish & Richarson P.C.

[57] ABSTRACT

A method of laying floors or like surfaces with desired material, wherein the floors or like surfaces are supported by or comprised of rigid units in the form of boards or like elements. The boards are provided with tongues and grooves on respective edges thereof to enable boards to be joined to mutually adjacent boards. The method is mainly characterized by using boards that have been provided with a friction layer on their undersides. A corresponding friction layer is placed on the underlying sub-floor. A sheet of material is removably placed on the underside of the boards and transfers and places one board adjacent to another board. The boards are laid loosely on the friction layer of the sub-floor and mutually joined to adjacent boards solely by coacting between the tongues and grooves of respective boards in the absence of any binder.

14 Claims, 1 Drawing Sheet

Fig. 3
Fig. 1
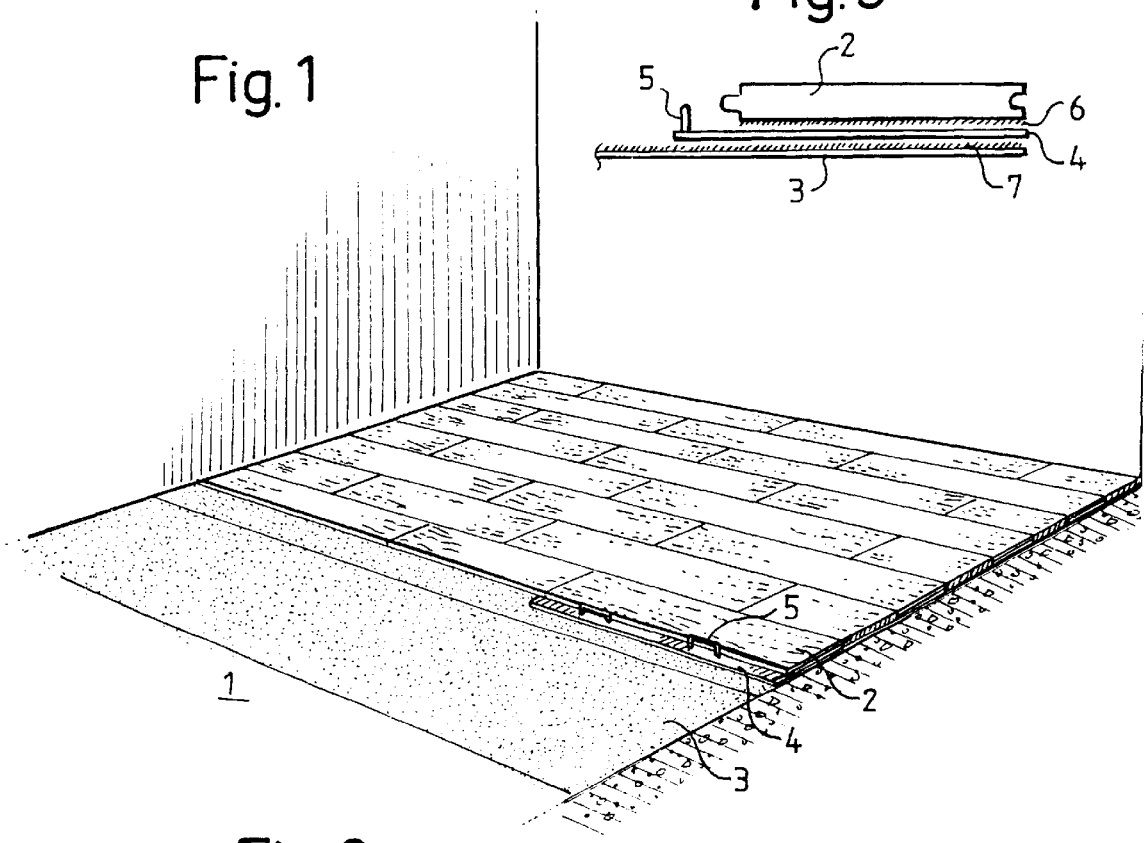
Fig. 2
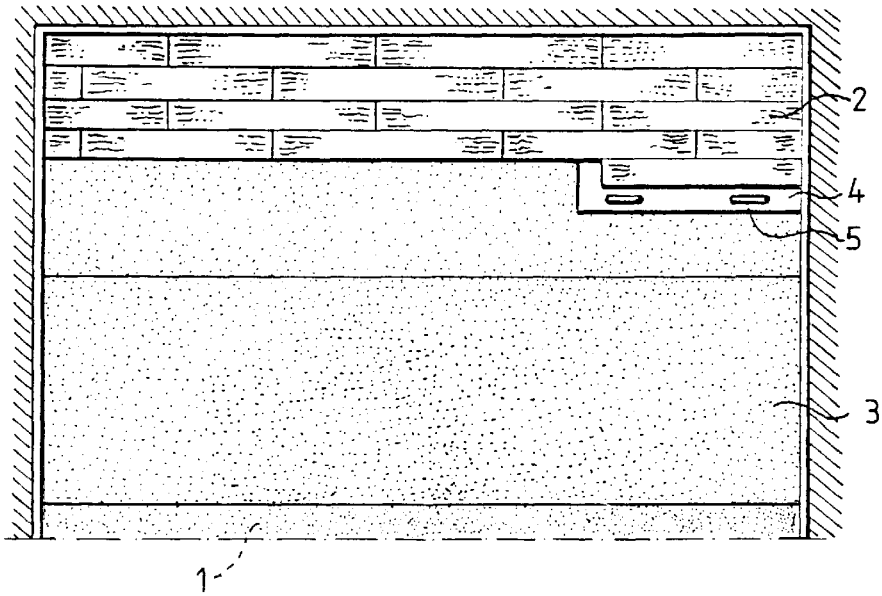

FLOOR-LAYING

CROSS REFERENCE TO RELATED APPLICATIONS

This application claims priority from PCT Application PCT/SE95/01504, filed Dec. 13, 1995.

The present invention relates to a method of laying floors or like surfaces of desired material, which are supported by or themselves comprises rigid units in the form of boards or the like which are tongued and grooved on respective sides so as to enable mutually adjacent boards to be joined together. The invention also relates to floor-laying material for use when carrying out the method.

When applying the method for laying so-called hard floors with parquet boards or rigid sheets, such as laminated board or sheets, squares or blocks of desired material, the boards or corresponding elements are normally placed loosely on a sub-floor and then glued together with glue applied to the tongues so as to obtain a floating floor. The gluing procedure constitutes an additional time-consuming task and also means that the floor will be a permanent fixture, i.e. cannot be removed without first breaking-up the floor. A sheet of paperboard or plastic foam is laid over the sub-floor prior to laying the floor, as a means of damping impact sound.

There are many occasions when there is a need for temporary floors, for instance in the case of exhibitions, trade fairs and other organized events. Great savings could be made in such cases if it were possible to lay the floor without needing to join the various boards or the like permanently together. This would enable a floor to be readily lifted after a temporary event and reused on a later occasion. Such a floor could also be used conveniently in, e.g., rented apartments, so that the tenant of such an apartment could take the floor with him when moving out. Such a floor would have no detrimental effect on the remainder of the apartment.

A floating floor that has been loosely laid in the afore-described manner also eliminates the time and cost involved by the gluing procedure.

SUMMARY

A main object of the present invention is to provide a method of loosely laying floating floors. Another object of the invention is to provide floor-laying material for use when applying the method.

The invention is based on the realization that floor coverings or the like which in use are influenced by forces that have at least one force component that acts perpendicularly to the surface can be constructed of units which are loose in relation to one another, provided that when subjected to load there is sufficiently high friction between the loose units and the sub-floor to prevent lateral displacement of said units under load.

The object of the invention is achieved with a method of the kind defined in the introductory paragraph which is characterized by the steps of using boards that have a friction layer on the underside thereof, providing the underlying floor with a corresponding friction layer, and loosely laying the boards on the friction layer on the sub-floor and connecting the mutually adjacent boards solely through the medium of mutually coacting tongues and grooves in the absence of any binder.

The method enables a top floor to be laid very quickly and effectively, because it is not necessary to glue the boards together. A floor that has been laid in accordance with the invention can be removed very easily when so desired and relaid in another place.

The friction layer on the sub-floor is conveniently provided by laying-out plastic foil or some like carrier provided with a friction layer on.

Laying of a floorboard is suitably facilitated by placing on the friction layer on the sub-floor a thin flexible sheet, e.g. foil, that has a smooth surface and a size which at least corresponds to the size of the board, said foil or flexible sheet being removed only when the board concerned has been joined to adjacent boards through the mutual coaction of said tongues and grooves.

In a particularly preferred embodiment of the invention, there are used boards whose undersurfaces are provided with a friction layer that has been produced by flocking, wherein the sub-floor is covered with plastic foil or the like having a corresponding flocked friction layer.

It has been found that the thus treated boards will hold together when subjected to load equally as effectively as when glued together. Furthermore, the two flocked layers effectively dampen impact sound.

The main characteristic features of the floor-laying material for use when applying the inventive method are set forth in the following Claims.

DESCRIPTION OF THE DRAWINGS

The invention will now be described in more detail with reference to the accompanying drawing, in which FIG. 1 is a schematic perspective view illustrating laying of a top floor in accordance with the invention;

FIG. 2 is a horizontal view of the floor shown in FIG. 1; and

FIG. 3 is a side view showing the board last laid in the floor.

DETAILED DESCRIPTION

The Figures illustrate a hard sub-floor 1, e.g. a concrete sub-floor, on which there is to be laid a so-called top floor comprised of parquet boards or laminate boards 2. The boards 2 have tongues and grooves on respective sides, in a typical manner. According to the invention, each board is provided on its underside with a friction layer 6, which in the embodiment most preferred has been produced by flocking.

The reference numeral 3 identifies layers of plastic foil or some other pliable material which has a friction layer 7 flocked on its upper surface. The mutual coaction between flocks or fibers in the friction layer of the foil 3 and the friction layer on a board 2 prevents lateral displacement of the board when subjected to load.

This effect is achieved as a result of the layers 6, 7 of short fibers firmly glued at right angles to respective surfaces by flocking. When the two layers are pressed together with nothing therebetween, the fibers of the two layers will engage one another and therewith make lateral movement impossible.

Flocking is effected in a known manner, by first applying, normally spraying glue onto respective surfaces. The surfaces are then flocked by "firing" short fibers of desired material into the adhesive electrostatically, the electric field causing the fibers to position themselves at right angles to the surface. The product is then dried and surplus fibers removed if necessary. The fibers used are suitably made of a plastic material, such as polyamide, rayon, polyester or like material. Layers which when pressed together are highly resistant to lateral movement of the layers relative to one another can be achieved by appropriate selection with regard to the coarseness and lengths of the fibers used.

The boards and the foil material are conveniently flocked at their place of manufacture. For instance, the sheet-like planks from which the boards are produced may be flocked prior to sawing the planks into individual boards.

It will be understood, however, that the principle of the invention can also be applied with friction surfaces that have been produced on the underside of the boards and on the upper side of the sub-floor in some other way.

When the frictional forces acting between a board 2 and the friction layer 7 of the underlying sub-floor are very great, displacement of a board 2 in the plane of the board in order to mate with the tongues and grooves of adjacent boards can be facilitated by using a sliding-facilitating intermediate element such as a semi-stiff sheet of appropriate material or foil material 4 which is at least the same size as the board 2. This intermediate element is first laid on the sub-floor so as to cover a selected part of its friction layer 7. Reference number 5 identifies two handles which facilitate handling of the sheet 4.

The sheet 4 will preferably have smooth surfaces so as to enable the overlying board 2 to be moved easily into mating engagement with adjacent boards. When the board has been laid, the sheet 4 can be readily pulled out from its position between the board and the underlying sub-floor, so that the friction surface on the board 2 will coact with the friction surface 6 on the sub-floor in the desired manner. The sheet 4 is then moved to the position of the next board to be laid.

The aforedescribed method can be applied in laying parquet boards, laminated boards, laminated sheets, so-called square laminates, parquet blocks and like floor elements. The inventive method also provides the additional advantage of effectively reducing sound transmissions, particularly in the case of floors constructed from plastic-laminated boards or sheets.

I claim:

1. A method of laying a floor surface using rigid units, each unit having a tongue on one side edge and a groove on an opposite side edge to enable adjacent units to be joined together, and each unit further having an underside with a friction layer to coact with a corresponding friction layer on an underlying sub-floor, the method comprising:

placing on the friction layer of the sub-floor a sheet of material that prevents the friction layer of a rigid unit from coming into contact with the friction layer of the sub-floor while the rigid unit is being joined to an adjacent rigid unit with the aid of a tongue and a groove, laying a first rigid unit on the sheet of material, joining the first rigid unit to an adjacent rigid unit using a tongue of one of the first rigid unit and the adjacent rigid unit and a groove of the other of the first rigid unit and the adjacent rigid unit, removing the sheet of material from beneath the first rigid unit so that the friction layer of the first rigid unit coacts with the friction layer of the sub-floor to secure the first rigid unit, transferring the sheet of material to a place where a next rigid unit is to be laid after the first rigid unit has been mated with the adjacent rigid unit, laying a second rigid unit on the transferred sheet of material, joining the second rigid unit to the first rigid unit using a tongue of one of the first rigid unit and the second rigid unit and a groove of the other of the first rigid unit and the second rigid unit.

2. The method of claim 1, wherein friction layers of the rigid units comprise flocked friction lagers and the sub-floor comprises a corresponding flocked friction layer.

3. The method of claim 1, wherein the rigid units comprise wooden boards.

4. The method of claim 3, wherein the friction layers of the rigid units comprise flocked friction layers.

5. The method of claim 1, wherein the friction layers of the rigid units comprise flocked friction layers.

6. The method of claim 1, wherein joining the rigid units comprises joining the rigid units solely through interaction of the tongues and grooves of the rigid units, and in the absence of other binders between the rigid units.

7. The method of claim 1, further comprising securing the rigid units to the sub-floor solely through interaction of the friction layers of the rigid units with the sub-floor, and in the absence of other binders between the rigid units and the sub-floor.

8. The method of claim 1, wherein friction layers of the rigid units comprise flocked friction layers and the friction layer of the sub-floor comprises a corresponding flocked friction layer.

9. The method of claim 1, wherein the sheet of material has smooth upper and lower surfaces and removing the sheet of material comprises sliding the sheet of material from between the friction lagers.

10. The method of claim 1, wherein the sheet of material comprises a sheet of foil and removing the sheet of material comprises sliding the sheet of material from between the friction layers.

11. The method of claim 1, wherein the sheet of material comprises a flexible sheet of material and removing the sheet of material comprises sliding the sheet of material from between the friction layers.

12. The method of claim 1, wherein the sheet of material comprises a handle and removing the sheet of material comprises grasping the handle.

13. The method of claim 1, further comprising securing to the sub-floor a sheet of plastic foil on which a friction layer of the sub-floor is formed.

14. The method of claim 1, wherein the sheet of material is sized to cover an area on the sub-floor at least as large as an area on the sub-floor covered by a rigid unit.

* * * * *